US007583282B2

(12) United States Patent
Yamauchi et al.

(10) Patent No.: US 7,583,282 B2
(45) Date of Patent: Sep. 1, 2009

(54) IMAGE PRINTING APPARATUS AND IMAGE PRINTING METHOD

(75) Inventors: Kazumichi Yamauchi, Tokyo (JP); Satoshi Sakata, Tokyo (JP); Akira Okamoto, Tokyo (JP); Kenji Yamamoto, Tokyo (JP); Kazutoshi Yoshimura, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 158 days.

(21) Appl. No.: 11/521,049

(22) Filed: Sep. 14, 2006

(65) Prior Publication Data

US 2007/0153077 A1 Jul. 5, 2007

(30) Foreign Application Priority Data

Jan. 5, 2006 (JP) ..... 2006-000624
Jun. 28, 2006 (JP) ..... 2006-177725

(51) Int. Cl.
*B41J 2/435* (2006.01)

(52) U.S. Cl. ..... 347/234; 347/229; 347/248

(58) Field of Classification Search ..... 347/116, 347/248–250, 229, 234, 235; 399/301
See application file for complete search history.

(56) References Cited

U.S. PATENT DOCUMENTS 5,266,976 A * 11/1993 Ohigashi et al. ..... 347/116
6,219,085 B1 * 4/2001 Hanna ..... 347/249
6,300,968 B1 * 10/2001 Kerxhalli et al. ..... 347/116
6,667,756 B2 * 12/2003 Conrow et al. ..... 347/248
6,975,828 B2 * 12/2005 Bessho et al. ..... 399/301

FOREIGN PATENT DOCUMENTS

JP 08079633 A * 3/1996
JP 10-319674 12/1998
JP 2003-156974 5/2003
JP 2003156974 A * 5/2003

* cited by examiner

*Primary Examiner*—Hai C Pham
(74) *Attorney, Agent, or Firm*—Cantor Colburn LLP

(57) ABSTRACT

When images are to be printed on two, front and lower surfaces of a sheet, in order to register the position of the image on the front surface and the position of the image on the back surface highly accurately, an image printing apparatus of this invention includes an image printing section which forms the image for the front surface of the sheet as well as an image of a reference mark on a photosensitive member at one portion in a region outside an image printing region and transfers the images onto the front surface of the sheet, a fixing unit which fixes the transferred images on the sheet, a line sensor which detects the reference mark after fixing printed on the front surface of the sheet, an arithmetic operating section which obtains a shrinkage factor of the sheet on the basis of a size of the reference mark before fixing and a size of the detected reference mark after fixing and calculates a position and magnification of the image to be printed on the back surface on the basis of the shrinkage factor, and a control section which performs control operation to print the image on the back surface of the sheet on the basis of the calculated position and the calculated magnification.

26 Claims, 11 Drawing Sheets

IMAGE PRINTING APPARATUS AND IMAGE PRINTING METHOD

CROSS-REFERENCE TO RELATED APPLICATIONS

This application makes reference to, incorporates the same herein, and claims all benefits accruing under 35 U.S.C. §119 from applications for IMAGE PRINTING APPARATUS AND IMAGE PRINTING METHOD earlier filed respectively in the Japanese Patent Office on Jan. 5, 2006 and Jun. 28, 2006, and duly assigned with the applications Nos. 2006-000624 and 2006-177725.

BACKGROUND OF THE INVENTION

1. Field of the Invention

The present invention relates to an image printing apparatus such as a copying machine, a printer, a facsimile apparatus, and a multifunction peripheral of a copying machine, printer, and facsimile apparatus and, more particularly, to an image printing apparatus and image printing method which can register the positions of images to be printed on the front and back surfaces of a sheet highly accurately.

2. Description of Related Art

An electrophotographic image printing apparatus comprises a photosensitive member, an image write unit, developing portion, feeder, transfer portion, fixing unit, and the like, and can print images on the two surfaces of a sheet.

When printing images on the two surfaces of the sheet, the images on the two surfaces must be registered accurately. This is to prevent the following problems. For example, when a bundle of sheets P are cut or bound, if images printed on the front and back surfaces are misregistered, a blank may be left depending on the images, or the images may partly lack after cutting.

Conventionally, a mark is printed on the front surface of the sheet P, and the position of the mark is detected to correct the image-printing position on the back surface (for example, see Japanese Unexamined Patent Publication No. 10-319674 (patent reference 1)).

In an image printing apparatus which employs thermal fixing, when an image is printed and fixed on the front surface, the sheet P after fixing shrinks to shrink the image simultaneously. If an image is printed and fixed on the back surface in the same manner, the positions of the images printed on the front and back surfaces are misregistered. The method described in patent reference 1 is aimed at correcting the skew of the sheet P caused by a convey error or the like, and shrinkage of the image caused by the shrinkage of the sheet P due to the fixing process is not taken into account. Although the positions of the distal ends of the images on the front and back surfaces may be registered, it is impossible to set the positions and sizes of the images on the front and back surfaces to coincide with each other highly accurately.

Hence, in the image printing apparatus which employs thermal fixing, as the sheet P shrinks as described above, to obtain images on the front and back surfaces that coincide with each other, the position and size of the image to be printed on the back surface must be corrected.

Attempts have been made to print an image on the back surface considering the shrinkage of the sheet caused by the fixing process described above (for example, see Japanese Unexamined Patent Publication No. 2003-156974 (patent reference 2)). In the image printing apparatus described in patent reference 2, marks are printed at four corners on the front surface of a sheet P or at two portions in a direction (to be referred to as the "main scanning direction" hereinafter) perpendicular to the convey direction (to be referred to as the "sub-scanning direction" hereinafter) of the sheet P. The distances between the marks or the like before and after fixing the image on the front surface are obtained. The position and size of the image on the back surface are determined on the basis of the distances or the like.

With the image printing apparatus described in the above patent reference 2, however, the marks are printed at the four corners of the sheet P or at the two portions in the main scanning direction, and the marks serve as cutting marks used as marks in cutting the sheet P, or as color misregistration correction marks used in correction of color misregistration of the images. Thus, the following problems arise.

Since the marks are printed at the four corners of the sheet P or at the two portions in the main scanning direction, a large sensor detection range must be set, or a plurality of sensors must be provided. In order to arrange a one-dimensional line sensor in the main scanning direction to obtain the shrinkage factor in the convey direction of the sheet P, the entire sheet P must pass through the one-dimensional line sensors so the one-dimensional line sensor detects all the marks printed at the four corners or the like. Then, however, the shrinkage factor cannot be obtained until the sheet P has passed through the one-dimensional line sensor, and mark detection is delayed. To feedback the detection result of the one-dimensional line sensor to back surface image printing, the shrinkage factor must be obtained since the marks are detected until back surface image printing to correct the position and size of the image on the back surface. Because mark detection is delayed, the image printing section and the mark detection position, i.e., the position to set the one-dimensional line sensor, must be spaced apart from each other. In this manner, with the prior art, the position to set the sensor is limited.

To detect and recognize a cutting mark or color misregistration correction mark with the line sensor, the line sensor must read the mark quickly and frequently. A large-capacity memory is also necessary to store data read by the line sensor.

SUMMARY OF THE INVENTION

The present invention has been made to solve the problems described above, and can provide an image printing apparatus and image printing method which, when printing images on the two surfaces of a sheet, can register the positions and sizes of images to be printed on the front and back surfaces of the sheet highly accurately.

According to the present invention, there is provided an image printing apparatus for printing images on two, front and back surfaces of a sheet, comprising an image printing section which forms the image for the front surface of the sheet as well as an image of one reference mark on a photosensitive member in a region outside an image printing region and transfers the images formed on the photosensitive member onto the front surface of the sheet, a fixing unit which fixes the images on the sheet, a line sensor which detects the reference mark after the image on the front surface is fixed and before the image is printed on the back surface, an arithmetic operating section which obtains a shrinkage factor of the sheet on the basis of a size of the reference mark before fixing and a size of the detected reference mark after fixing and calculates a position and magnification of the image to be printed on the back surface on the basis of the shrinkage factor, and a control section which performs control operation to print the image on the back surface of the sheet on the basis of the calculated position and the calculated magnification.

According to the present invention, there is also provided an image printing method of printing images on two, front and back surfaces of a sheet, comprising the first image printing step of forming the image for the front surface as well as an image of a reference mark at one portion on a photosensitive member in a region outside an image printing region and transferring the images formed on the photosensitive member onto the front surface of the sheet, the fixing step of fixing the images onto the sheet, the detection step of detecting the reference mark after fixing which is printed on the front surface of the sheet with a line sensor, the arithmetic operation step of obtaining a shrinkage factor of the sheet on the basis of a size of the reference mark before fixing and a size of the detected reference mark after fixing and calculating a position and magnification of the image to be printed on the back surface on the basis of the shrinkage factor, and the second image printing step of printing the image on the back surface of the sheet on the basis of the calculated position and the calculated magnification.

According to the present invention, when printing the images on the two surfaces of the sheet, the position and size of the image on the front surface can be registered with those of the image on the back surface highly accurately.

According to the present invention, the shrinkage factor of the sheet can be obtained by only printing a reference mark at one position on the front surface to calculate the position and size of the image on the back surface.

Furthermore, according to the present invention, since the reference mark is printed at one portion on the front surface, it is possible to narrow the detection region of the line sensor more than in the prior art. Thus, the reference mark can be detected within a shorter period of time, and the amount of detected data can be small. As the mark can be detected within the short period of time, the mark can be detected immediately before printing the image on the back surface to calculate the position and size of the back surface image, so that the correction accuracy of the position and size can improve.

The present invention is more specifically described in the following paragraphs by reference to the drawings attached only by way of example.

BRIEF DESCRIPTION OF THE DRAWINGS

A more complete appreciation of the present invention, and many other attendant features and advantages thereof, will become apparent as the same becomes better understood by reference to the following detailed description when considered in conjunction with the accompanying drawings in which like reference symbols and numerals indicate the same or similar components, wherein.

DETAILED DESCRIPTION OF THE PREFERRED EMBODIMENTS

Some preferred embodiments of the present invention will be described below in detail with reference to the accompanying drawings.

First Embodiment

Figure 1:
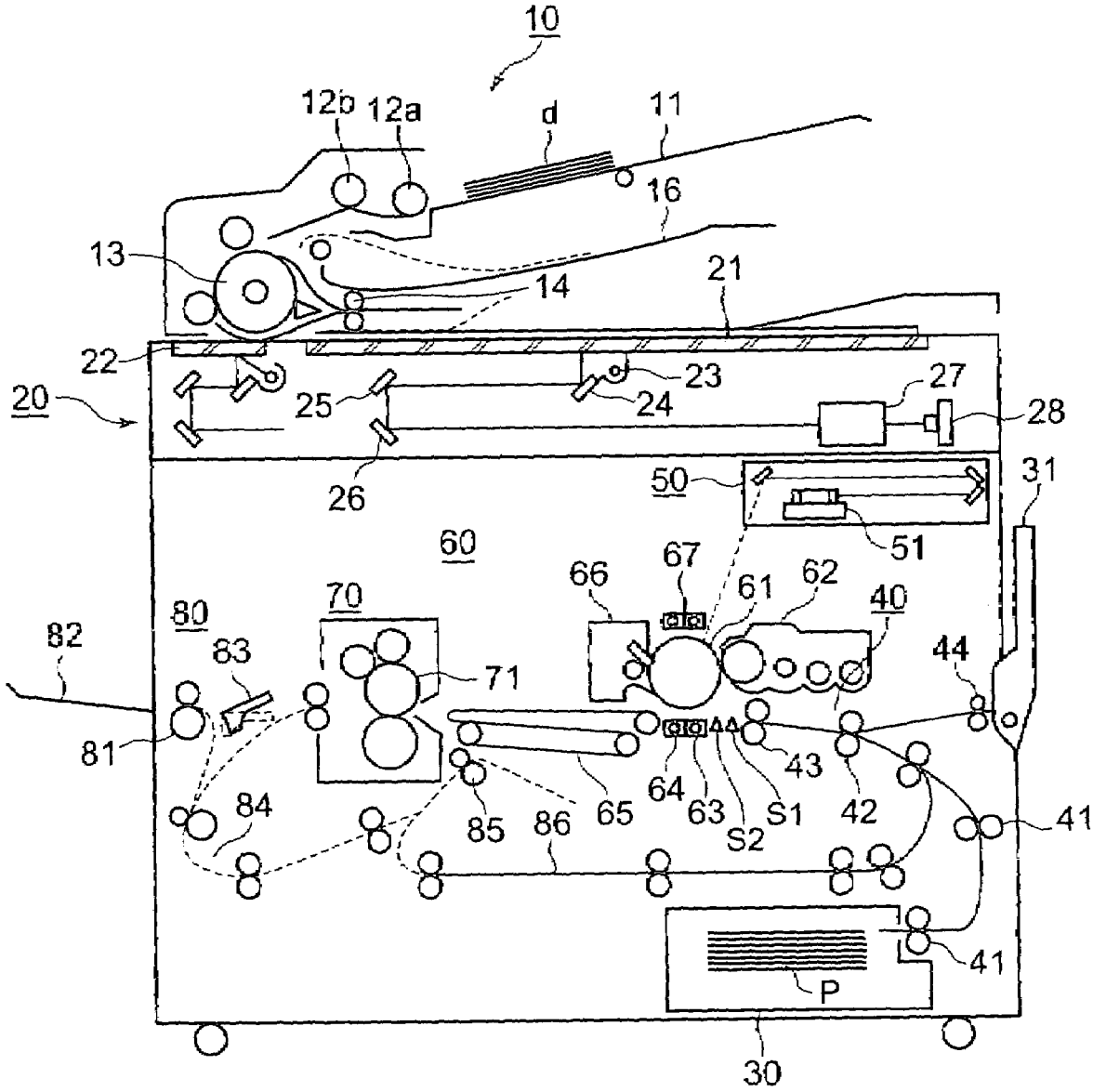
FIG. 1 is a sectional view showing the schematic entire arrangement of an image printing apparatus according to the present invention.

The arrangement of an image printing apparatus according to the first embodiment of the present invention will be described with reference to FIG. 1. FIG. 1 is a sectional view showing the arrangement of the image printing apparatus.

Reference numeral 10 denotes an automatic document feeder which conveys a document to read it. A plurality of documents d each with its first page facing up are placed on a document support 11 where the document is to be placed. The document d is fed out through rollers 12*a* and 12*b* and conveyed to an image reader 20 through a roller 13. The document d, the image of which is read by the image reader 20, is delivered to a delivery plate 16.

The image reader 20 optically scans the document d to generate image data. A light source 23 irradiates the document surface of the document d, and reflected light from the document d forms an image on the light-receiving surface of a CCD 28 serving as a photoconverting means through mirrors 24, 25, and 26 and a coupled optical system 27. When the document d placed on a platen glass 21 with its read surface facing down is to be read, the optical system 27 reads it by scanning it along the platen glass 21. When the document d is to be read while being conveyed, it is read with the light source 23 and mirror 24 being fixed under a second platen glass 22. The readout image data of the document d is sent from the CCD 28 to an image processor (not shown). When the document d is to be duplex-conveyed by the automatic document feeder 10, after its front surface is read, the document d is reversed and conveyed by reversing rollers 14 and conveyed to the roller 13 again. The back surface of the document d is read by the image reader 20. The read image data is sent from the CCD 28 to the image processor.

Sheets P are stacked on a feed tray 30. In FIG. 1, the feed tray 30 has only one stage. Alternatively, a plurality of stages of feed trays may be provided to stack sheets having different sizes.

A feeder 40 feeds the sheet P from the feed tray 30 to an image printing section 60. The sheet P is fed out from the feed tray 30 by convey rollers 41 and abutted against the nip portion of registration rollers 43 through loop rollers 42 to stop temporarily, so the skew of the sheet P with respect to the convey direction is corrected. Then, the sheet P is conveyed to a transfer portion 63 at a predetermined timing. Alternatively, the sheet P is fed out from a manual feed tray 31 by convey rollers 44 and conveyed to the transfer portion 63 via the same process.

An image write unit 50 forms an electrostatic latent image on a photosensitive member 61 of the image printing section 60 on the basis of the image data of the document d which is read by the image reader 20. A laser beam from a laser diode 51 corresponding to the image data irradiates the photosensitive member 61 of the image printing section 60 to form the electrostatic latent image.

The image printing section 60 prints an image on the sheet P in accordance with electrophotography. First, the laser beam from the laser diode 51 of the image write unit 50 irradiates the photosensitive member 61 which is uniformly charged by a charging portion 67, to form an electrostatic latent image. The electrostatic latent image formed on the photosensitive member 61 is developed by a developing portion 62 to form a toner image on the photosensitive member 61. The toner image is transferred onto the sheet P by the transfer portion 63 arranged under the photosensitive member 61. The sheet P abutted against the photosensitive member 61 is separated by a separating portion 64. The sheet P separated from the photosensitive member 61 is conveyed by a convey mechanism 65 to a fixing unit 70.

The fixing unit 70 fixes the toner image transferred onto the sheet P with heat and pressure.

A delivery unit 80 delivers the sheet P on which the image is printed. The sheet P printed with the image is delivered by delivery rollers 81 onto a delivery tray 82. When duplex image printing is to be performed, after an image is printed on the front surface, the sheet P is conveyed downward by a guide 83 and sent to a reversal path 84. The sheet P entering the reversal path 84 is reversed by reversal convey rollers 85 and sent to a reversal convey path 86. The sheet P entering the reversal convey path 86 is sent to the image printing section 60 again via the feeder 40.

The sheet P is then abutted against the nip portion of the registration rollers 43 through the loop rollers 42 to stop temporarily, so the skew of the sheet P with respect to the convey direction is corrected. After that, the sheet P is conveyed to the transfer portion 63 at a predetermined timing.

In the image printing section 60, a cleaning portion 66 removes the toner remaining on the photosensitive member 61 to prepare for the next image printing. In this state, the sheet P is loaded in the transfer portion 63 to print an image on its back surface. The sheet P separated from the photosensitive member 61 by the separating portion 64 is sent to the fixing unit 70 again through the convey mechanism 65 to fix the toner image on it. In this manner, the sheet P printed with the images on its front and back surfaces is delivered onto the delivery tray 82 by the delivery rollers 81.

In the present invention, the convey direction of the sheet P may be referred to as a sub-scanning direction, and a direction perpendicular to the convey direction of the sheet P may be referred to as a main scanning direction.

In the image printing apparatus according to the first embodiment, a sheet detection sensor S1 and line sensor S2 are arranged between the registration rollers 43 and image printing section 60. The sheet detection sensor S1 detects the leading edge of the sheet P. The line sensor S2 reads and detects a reference mark M (to be described later).

Figure 2:
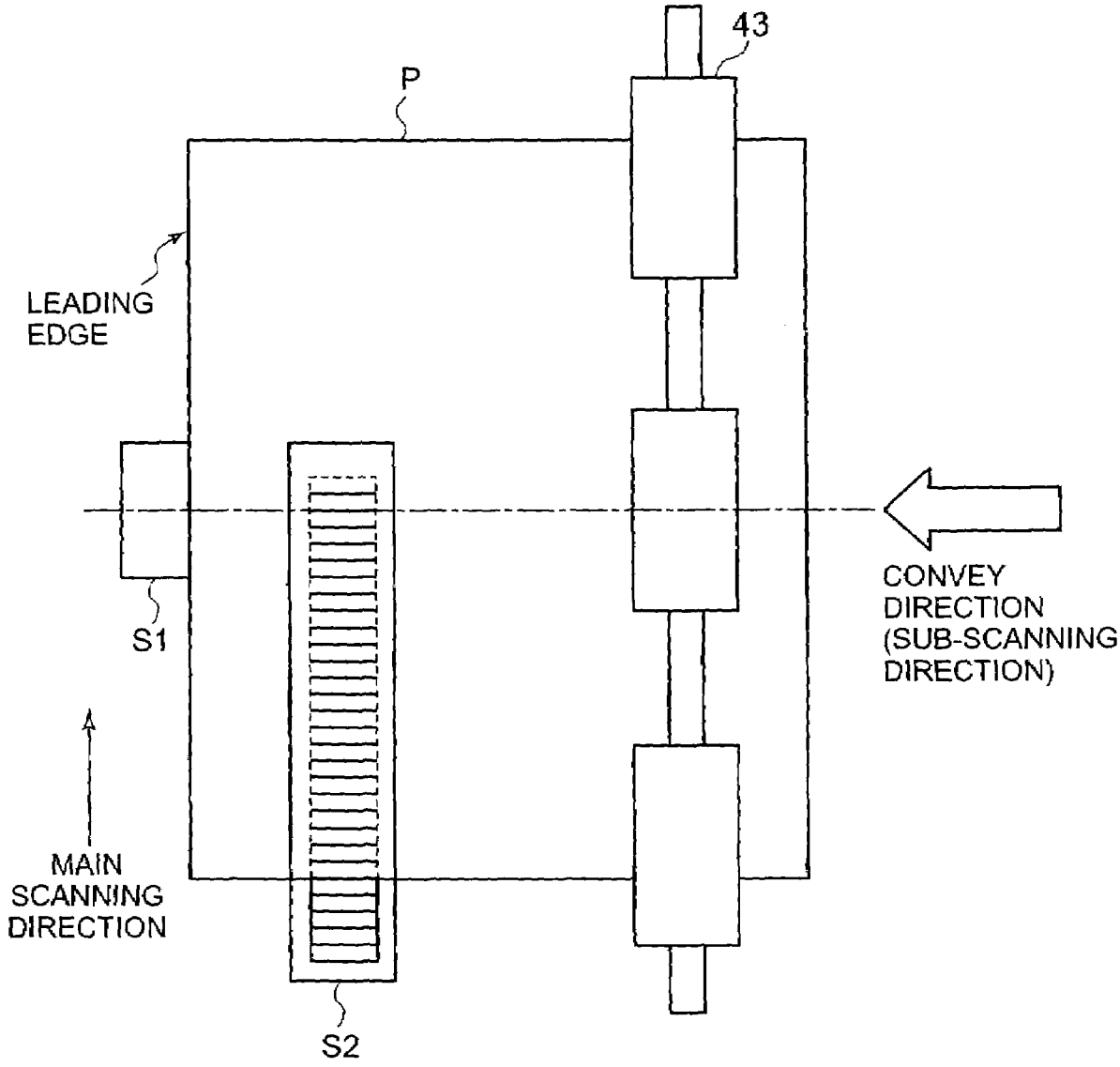
FIG. 2 is a view showing an example of a method of determining the position of an image to be printed on the front surface of a sheet.

As shown in FIG. 2, the sheet P is sent by the registration rollers 43 in the convey direction at a predetermined timing to be conveyed to the image printing section 60. In the image printing section 60, in printing an image on the front surface of the sheet P, when the sheet detection sensor S1 detects the leading edge of the sheet P, an image is printed on the sheet P at a position preset with reference to the leading edge of the sheet P.

Figure 3:
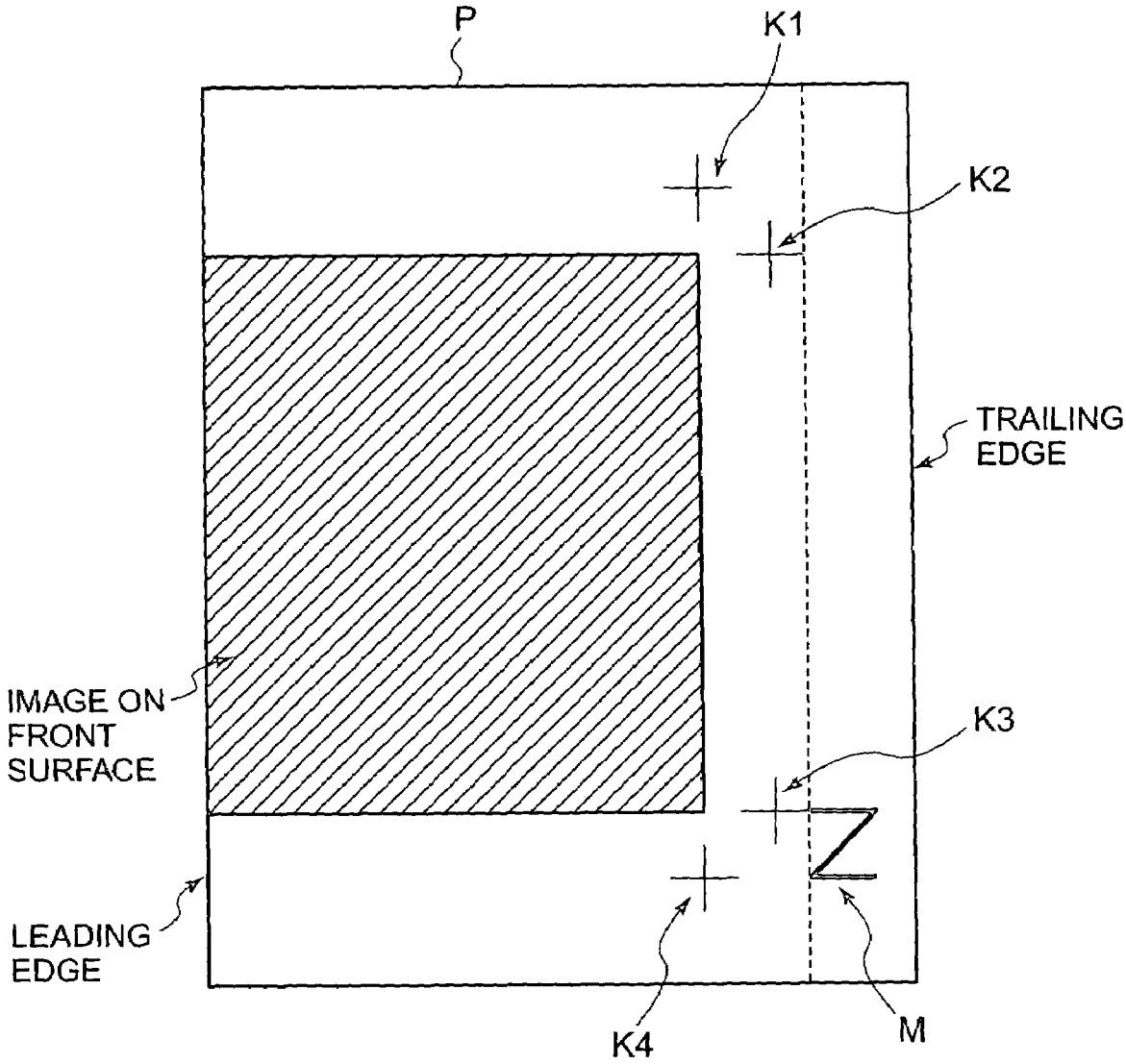
FIG. 3 is a view showing an image and reference mark printed on the front surface of the sheet.

For example, as shown in FIG. 3, the image is printed within an image region on the basis of image data with reference to the leading edge of the sheet P. Images of cutting marks K1 to K4 are printed at preset positions outside the image region. The cutting marks K1 to K4 serve as marks when cutting the sheet P. The sheet P is to be cut along the cutting marks K1 to K4. The image of the reference mark M is printed at a preset position outside the image region which is outside the cutting marks K1 to K4. According to the first embodiment, the reference mark M is printed at one portion outside the image region which is further outside the cutting marks in the main scanning direction and sub-scanning direction. The reference mark M serves as a reference in determining the position and size of an image to be printed on the back surface of the sheet P.

Figure 4:
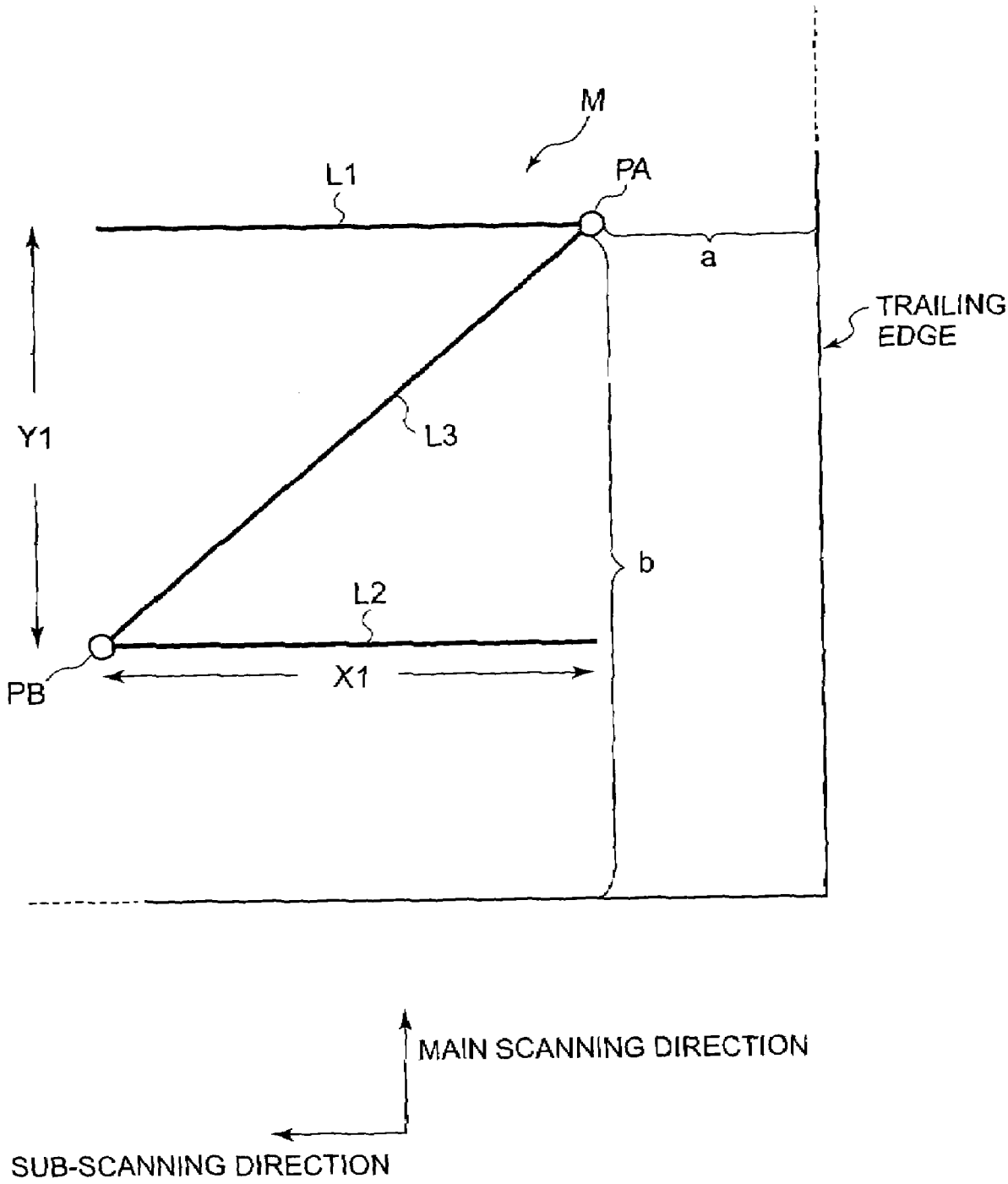
FIG. 4 is a view showing a reference mark printed on the front surface of the sheet.

The reference mark M will be described with reference to FIG. 4. FIG. 4 is a view showing the reference mark M printed on the front surface of the sheet P. The reference mark M consists of two, first and second straight lines L1 and L2 which are parallel to the sub-scanning direction, and a third straight line L3 which is oblique to the sub-scanning direction. In printing the reference mark M, the lengths of L1 and L2 are equal. One end of L3 is connected to the upstream end of L1 in the convey direction, and the other end of L3 is connected to the downward end of L2 in the convey direction. In other words, the reference mark M has a Z shape.

Assume that each of L1 and 2 has a length X1 in the sub-scanning direction, and that the length between L1 and L2 is Y1. Assume that the intersection point of L1 and L2 is determined as a reference point PA, and the intersection point of L2 and L3 is determined as a reference point PB. The reference point PA serves as a reference in determining the image region of the back surface. The reference point PA in printing the mark M is printed at a position which is at a distance a from the trailing edge of the sheet P and at a distance b from the side surface of the sheet P. The size of the reference mark M in mark printing and the position to print the reference mark M are preset and stored in a storage section 3. Regarding the size, the lengths X1 and Y1 are stored in advance. Regarding the position, the distances a and b which define the position of the reference point PA are stored in advance. The length X1 corresponds to the "second length before fixing" of the present invention, and the length Y1 corresponds to the "first length before fixing" of the present invention. The reference point PA corresponds to the "first reference point" of the present invention, and the reference point PB corresponds to the "second reference point" of the present invention.

In the first embodiment, one end of L3 is connected to the upstream end of L1 in the convey direction, and the other end of L3 is connected to the downstream end of L2 in the convey direction. However, the shape of the reference mark M according to the present invention is not limited to Z. For example, an oblique third straight line may intersect the first and second straight lines to form the reference mark M.

The sheet P printed with the image on its front surface is fixed by the fixing unit 70 and delivered onto the delivery tray 82 by the delivery rollers 81. When duplex image printing is to be performed, after the image is printed and fixed on the front surface, the sheet P is conveyed downward by the guide 83 and sent to the reversal path 84. The sheet P entering the reversal path 84 is reversed by the reversal convey rollers 85 and sent to the reversal convey path 86. The sheet P entering the reversal convey path 86 is sent to the image printing section 60 again via the feeder 40.

Figure 5:
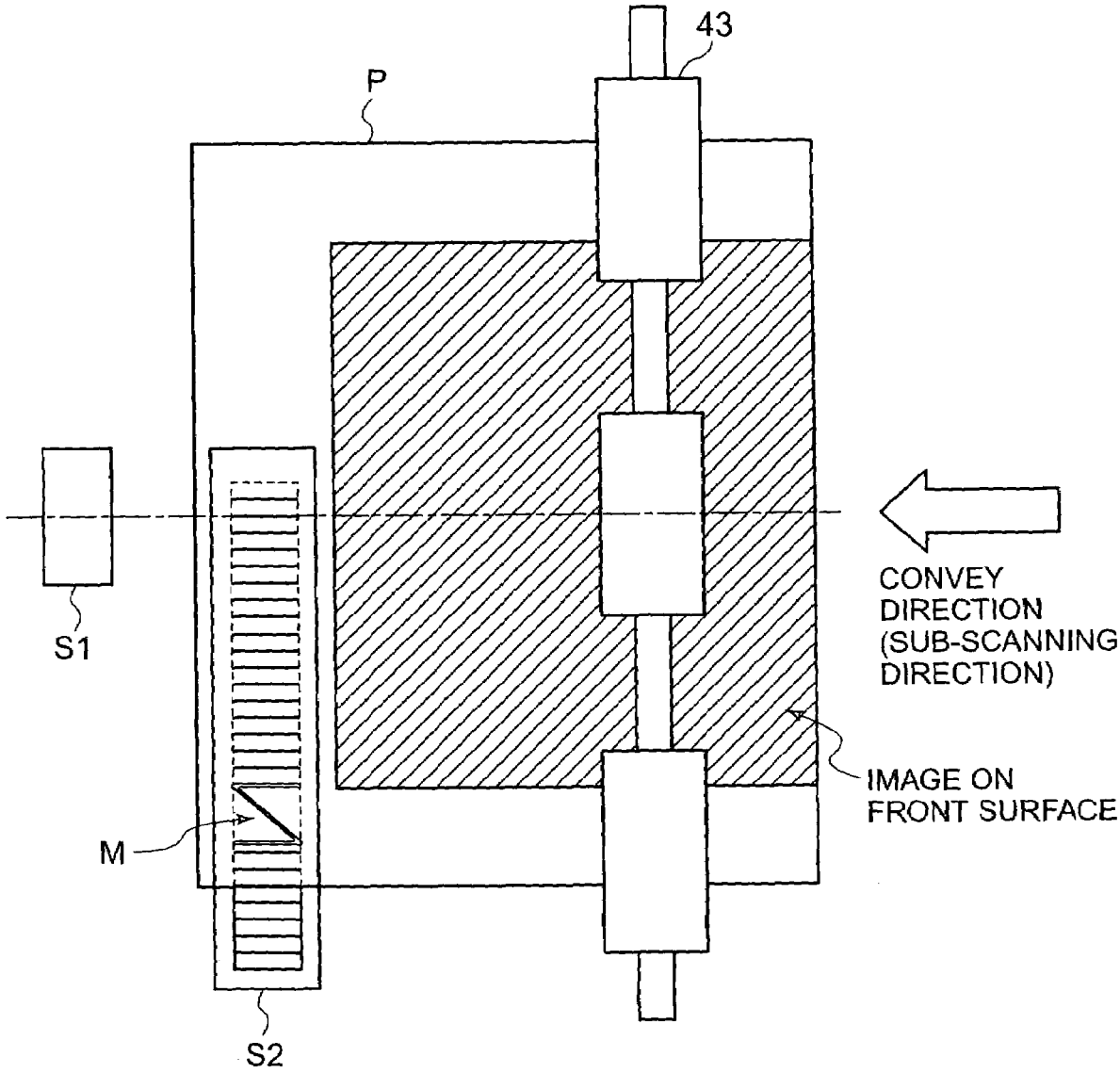
FIG. 5 is a view showing an example of a method of detecting a mark when printing an image on the back surface of the sheet.

A method of detecting the reference mark M in printing the image on the back surface of the sheet P will be described. FIG. 5 is a view showing an example of the method of detecting the reference mark M in printing the image on the back surface of the sheet P. As shown in FIG. 5, the sheet P is sent by the registration rollers 43 in the convey direction at a predetermined timing to be conveyed to the image printing section 60. The line sensor S2 reads and detects the reference mark M printed on the front surface of the sheet P from under the reversed sheet P. The position information of the reference mark M detected by the line sensor S2 is output to a control section 1 shown in FIG. 6 which has an arithmetic operating section 2.

Figure 6:
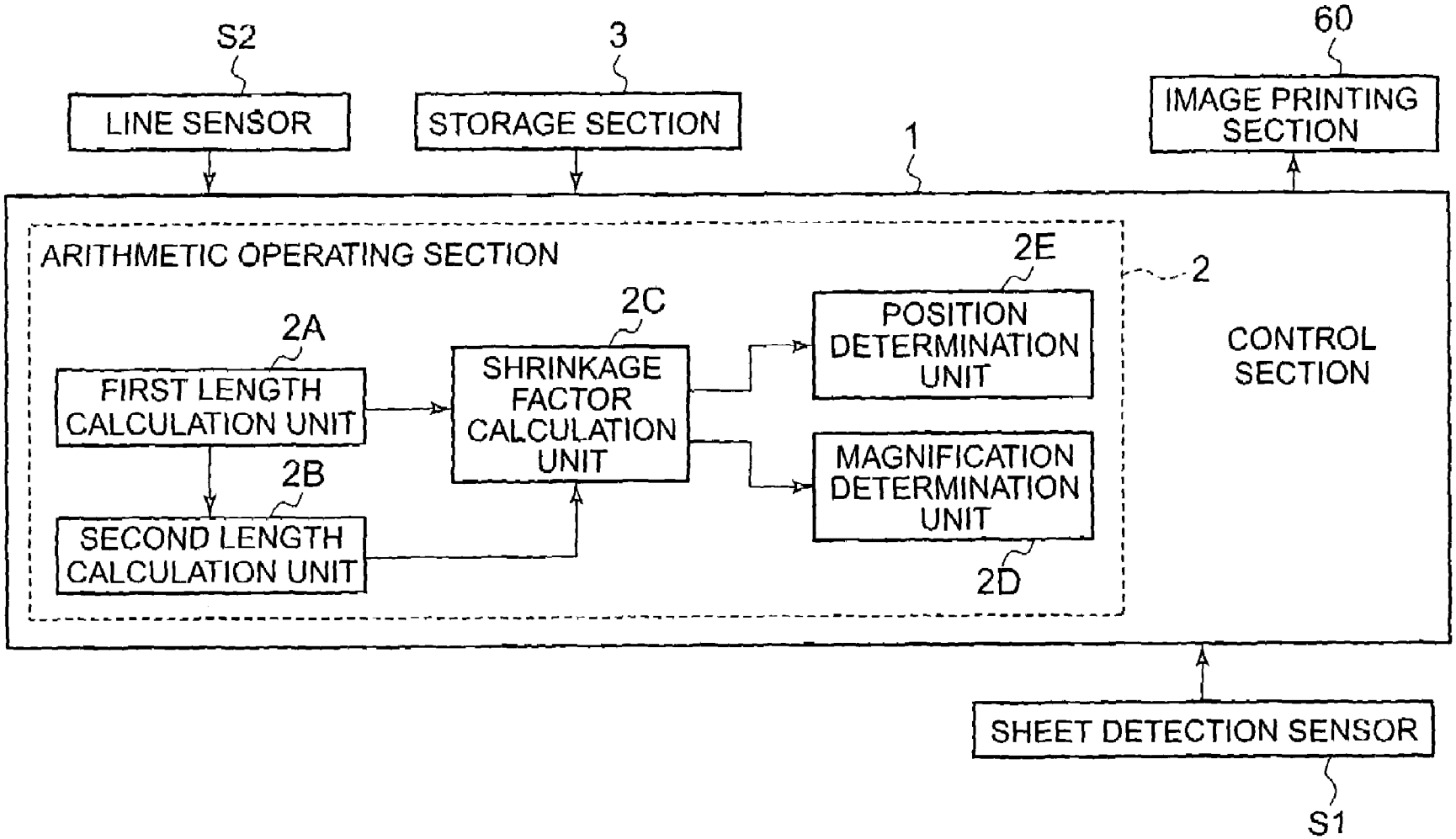
FIG. 6 is a control block diagram of an image printing apparatus according to the first embodiment.

The arithmetic operating section 2 shown in FIG. 6 obtains the shrinkage factor of the sheet P on the basis of the position information on the reference mark M in mark printing and the position information on the reference mark M detected by the line sensor S2. More specifically, the arithmetic operating section 2 obtains the shrinkage factor of the sheet P that has shrunk by the fixing process on the basis of the position information on the reference mark M before fixing and the position information on the reference mark M after fixing.

Figure 7:
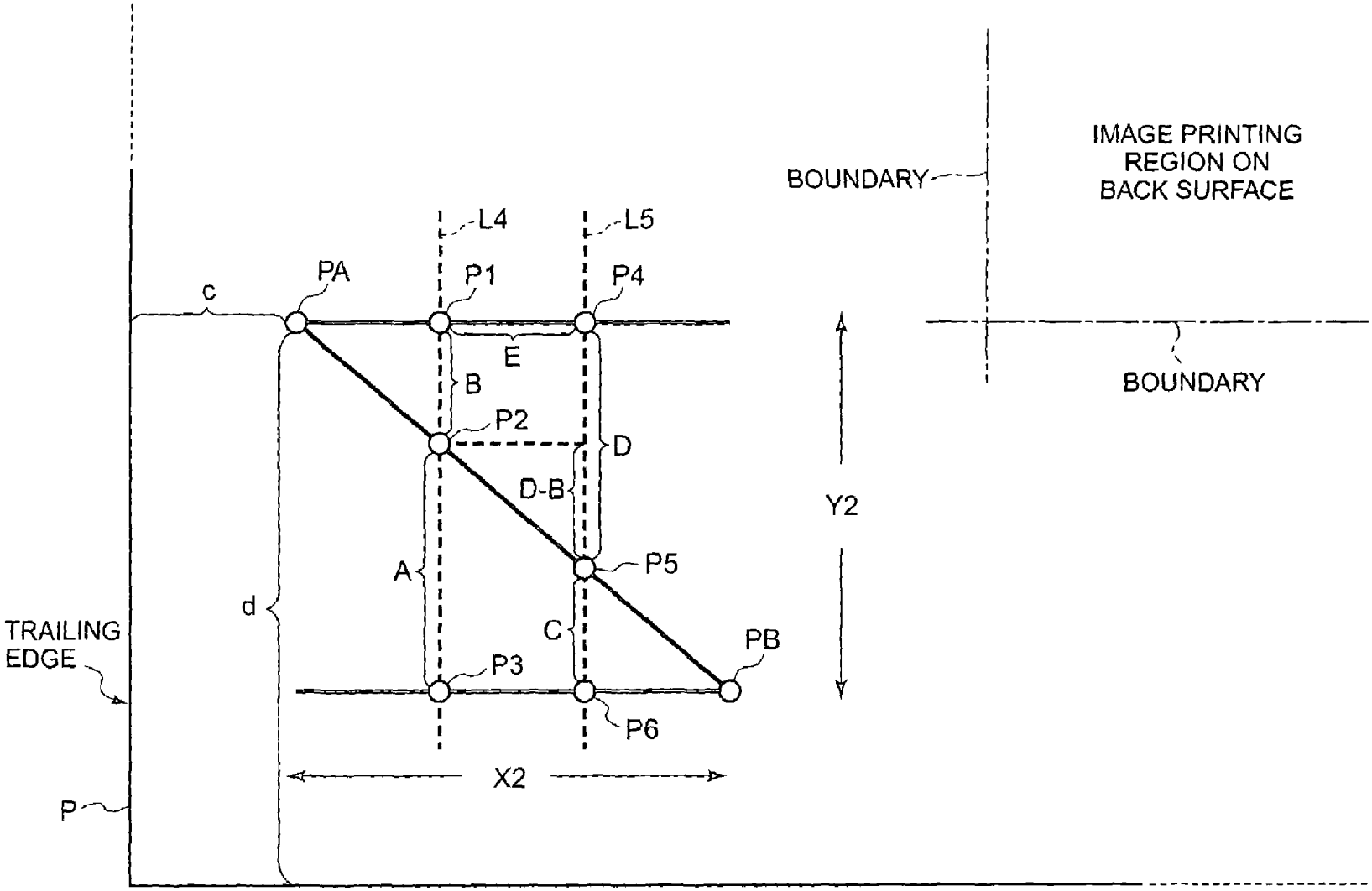
FIG. 7 is a view for explaining a process of obtaining the position and magnification of an image to be printed on the back surface.

A method of calculating the shrinkage factor of the sheet P by the arithmetic operating section 2 will be described with reference to FIG. 7. FIG. 7 is a view for explaining a process of obtaining the position and magnification of the image to be printed on the back surface.

For example, when the line sensor S2 scans two portions on scanning lines L4 and L5 of the reference mark M, as shown in FIG. 7, it reads intersection points P1 to P3 where the scanning line L4 intersects the reference mark M and intersection points P4 to P6 where the scanning line L5 intersects the reference mark M. Although the line sensor S2 scans the two portions of the reference mark M in the first embodiment, it can scan three or more portions. In this case, the line sensor S2 reads the points where the scanning lines of respective scanning intersect the reference mark M.

A first length calculation unit 2A obtains a length Y2 between the intersection points P1 and P3 or between the intersection points P4 and P6. The length Y2 represents the length of the reference mark M after fixing in the main scanning direction on the front surface. The first length calculation unit 2A also obtains a length A between the intersection points P2 and P3, a length B between the intersection points P1 and P2, a length C between the intersection points P5 and P6, and a length D between the intersection points P4 and P5. Information on the length Y2 of the reference mark M after fixing in the main scanning direction on the front surface is output to a second length calculation unit 2B and shrinkage factor calculation unit 2C. Pieces of information on the lengths B and D are output to the second length calculation unit 2B. The length Y2 corresponds to the "first length after fixing" of the present invention.

The second length calculation unit 2B obtains a length X2 of the reference mark M in the sub-scanning direction on the basis of the convey speed of the sheet P, the main-scanning time interval required when the line sensor S2 scans in the main scanning direction along the scanning lines L5 and L4, and the lengths Y2, B, and D. The main-scanning time interval required when the line sensor S2 scans in the main scanning direction along the scanning lines L5 and L4 is a preset time interval and stored in the storage section 3. For example, the second length calculation unit 2B obtains the length X2 in the sub-scanning direction on the basis of the following equation. Note that a length E between the intersection points P1 and P4 satisfies:

$$E=(\text{convey speed [mm/sec] of sheet } P)\times(\text{main-scanning time interval [sec]})$$

A relation (D−B):Y2=E:X2 is established from the similarity. Expansion of this relation yields:

$$X2=\{Y2/(D-B)\}\times E \quad (1)$$

The second length calculation unit 2B calculates the length X2 in the sub-scanning direction in accordance with the above equation. Information on the length X2 is output to the shrinkage factor calculation unit 2C. The length X2 corresponds to the "second length after fixing" of the present invention.

The shrinkage factor calculation unit 2C obtains the shrinkage factor of the sheet P from the lengths X2 and Y2 after fixing and the lengths X1 and Y1 of the reference mark M in mark printing which are stored in the storage section 3. X2/X1 corresponds to the shrinkage factor in the sub-scanning direction, and Y2/Y1 corresponds to the shrinkage factor in the main scanning direction. Regarding the shrinkage factor in the main scanning direction, the shrinkage factor calculation unit 2C calculates a shrinkage factor (Y2/Y1) of the sheet P in the main scanning direction on the basis of the length Y2 obtained by the first length calculation unit 2A and the length Y1 of the reference mark M in mark printing. Regarding the shrinkage factor in the sub-scanning direction, the shrinkage factor calculation unit 2C calculates a shrinkage factor (X2/X1) of the sheet P in the sub-scanning direction on the basis of the length X2 obtained by the second length calculation unit 2B and the length X1 of the reference mark M in mark printing.

For example, if X1=10 [mm], Y1=10 [mm], X2=9.9 [mm], and Y2=9.9 [mm], the shrinkage factor in the sub-scanning direction is 99 [%], and the shrinkage factor in the main scanning direction is also 99 [%].

A magnification determination unit 2D determines the magnification of an image to be printed on the back surface on the basis of the shrinkage factor of the sheet P calculated by the shrinkage factor calculation unit 2C. The magnification of the image to be printed on the back surface will be described. The magnification determination unit 2D reduces the original image data on the image to be printed on the back surface in accordance with the shrinkage factor obtained by the shrinkage factor calculation unit 2C. For example, if the shrinkage factor in the sub-scanning direction is 99 [%], the length in the sub-scanning direction of the image to be printed on the back surface is set to 99 [%] the original image data. If the shrinkage factor in the main scanning direction is 99 [%], the length in the main scanning direction of the image to be printed on the back surface is set to 99 [%] the original image data. Thus, the image to be printed on the back surface is reduced as a whole to 97.01 [%] the original back surface image data and printed on the back surface.

A position determination unit 2E determines the position of the image printing region on the back surface on the basis of the shrinkage factor of the sheet P which is calculated by the shrinkage factor calculation unit 2C. Regarding the position of the image printing region on the back surface, it is determined with reference to the reference point PA after fixing. For example, as shown in FIG. 7, assume that a position spaced apart from the reference point PA of the reference mark M after fixing by a predetermined distance is determined as the boundary of the image printing region on the back surface. The position of the reference point PA after fixing shifts from the position in mark printing by an amount corresponding to the shrinkage factor of the sheet P. Thus, the position determination unit 2E determines the image printing region on the back surface with reference to the reference point PA after fixing which has been shifted by the shrinkage.

In mark printing, as shown in FIG. 4, the reference mark M is printed such that the reference point PA is located at a position which is at the distance a from the trailing edge of the sheet P and at the distance b from the side surface of the sheet P. After the image is transferred to the front surface and fixed, the position of the reference point PA after fixing shifts by the amount corresponding to the shrinkage factor of the sheet P to be located at a distance c from the trailing edge and at a distance d from the side surface, as shown in FIG. 7. For example, if the shrinkage factor in the main scanning direction is 99 [%] and the shrinkage factor in the sub-scanning direction is 99 [%], the distance c is shorter than the distance a by 1.0 [%], and the distance d is shorter than the distance d by 1.0 [%]. In this manner, the position which shifts from the position of the reference point PA in mark printing by the amount corresponding to the shrinkage factor is determined as the reference point PA after fixing. The position which is at the distance c from the trailing edge and at the distance d from the side surface is determined as the position of the reference point PA, and a position spaced apart from the reference point PA by a predetermined distance is determined as the boundary of the image printing region on the back surface.

The control section 1 controls the image printing section 60 on the basis of the magnification of the image to be printed on the back surface from the magnification determination unit 2D and the position information on the image printing region on the back surface from the position determination unit 2E. The image printing section 60 prints an image on the back surface of the sheet P under the control of the control section 1.

The control section 1 is connected to the respective units of the image printing apparatus, e.g., the image reader 20, feeder 40, image write unit 50, image printing section 60, and fixing unit 70, and controls processes such as transfer, fixing, and reversal. The control section 1 comprises a CPU or the like and reads an arithmetic operation program from a storage section (not shown) to execute the function of the arithmetic operating section 2.

Although not shown, the image printing apparatus comprises an operation panel including an input unit and display unit. When a key or the like on the operation panel is pressed, a signal corresponding to the pressed key is input to the control section 1. The display unit displays an image or a text such as a message on the window in accordance with the indication of a display signal output from the control section 1.

Figure 8:
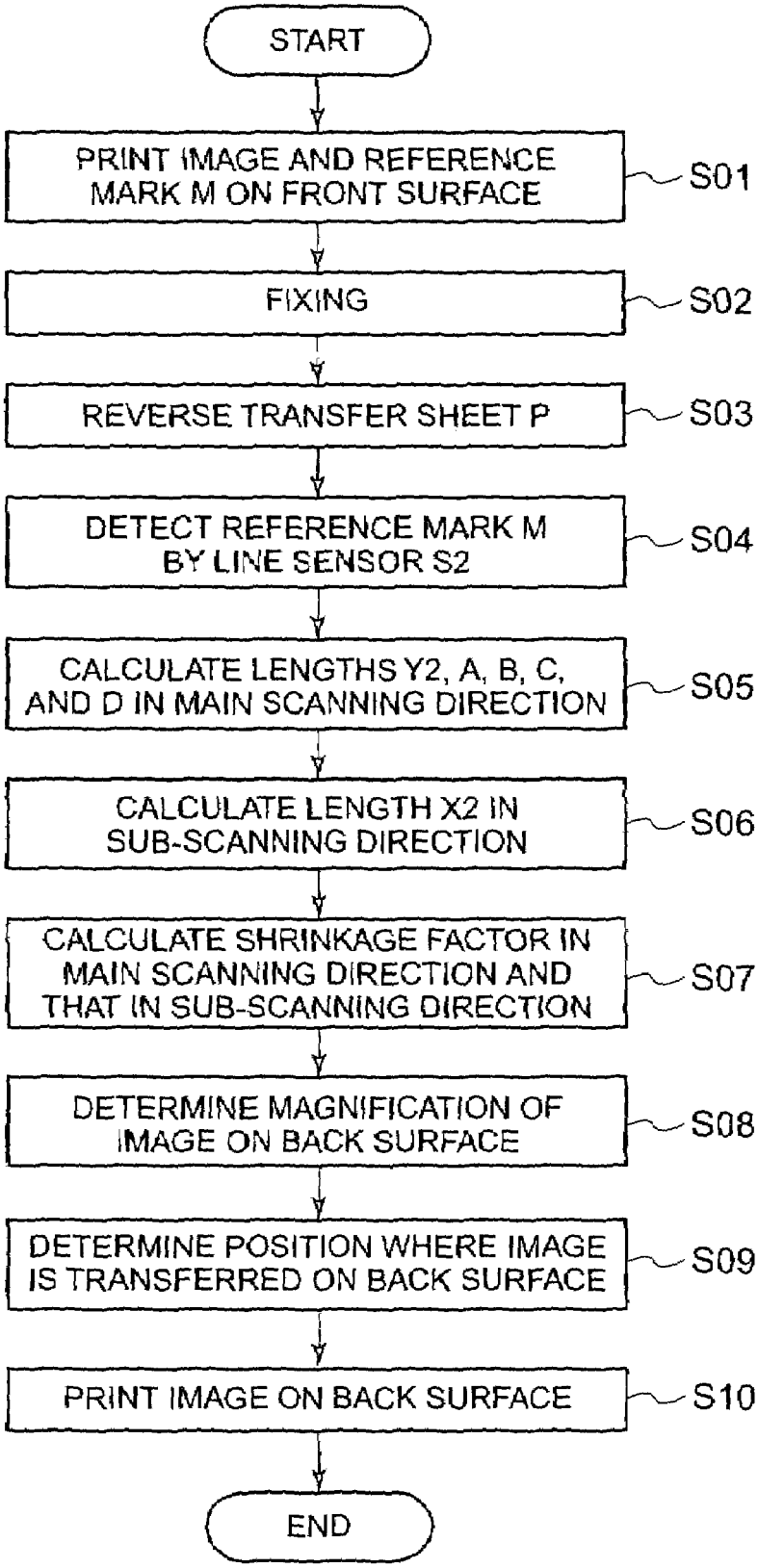
FIG. 8 is a flowchart showing the control operation of the image printing apparatus according to the first embodiment.

The control operation of the image printing apparatus according to the first embodiment will be described with reference to FIG. 8. FIG. 8 is a flowchart showing the control operation of the image printing apparatus according to the first embodiment of the present invention.

(Step S01)

In step S01, the image printing section 60 prints an image and the reference mark M on the front surface of the sheet P. This will be described in detail. At a predetermined timing, the registration rollers 43 feed the sheet P conveyed from the feed tray 30 to the image printing section 60, as shown in FIG. 2. When the sheet detection sensor S1 detects the leading edge of the sheet P, the image printing section 60 prints an image at a position preset with reference to the leading edge of the sheet P, as shown in FIG. 3. Furthermore, the image printing section 60 prints the cutting marks K1 to K4, and the substantially Z-shaped reference mark M shown in FIG. 4 at a preset position in a region outside the cutting marks K1 to K4. The reference mark M is printed at one portion on the trailing edge side of the sheet P.

The size and position information on the reference mark M in mark printing are stored in the storage section 3. For example, as the size of the reference mark M, the length X1 in the sub-scanning direction and the length Y1 in the main scanning direction during mark printing are stored in the storage section 3. As the position information on the reference mark M, the position information on the reference point PA is stored. For example, the distance a from the trailing edge of the sheet P and the distance b from the side surface are stored in the storage section 3 as the position information on the reference point PA.

(Step S02)

In step S02, the sheet P is conveyed to the fixing unit 70. The fixing unit 70 fixes the images of the cutting marks K1 to K4 and reference mark M on the front surface.

(Step S03)

In step S03, the sheet P fixed with the image on its front surface is reversed and conveyed to the image printing section 60 again. More specifically, the sheet P fixed with the image on its front surface is conveyed downward by the convey path switching guide 83 shown in FIG. 1 and sent to the reversal path 84. The sheet P is reversed by the reversal convey rollers 85 and sent to the image printing section 60 again via the reversal convey path 86.

(Step S04)

In step S04, as shown in FIG. 5, the reversed sheet P is sent by the registration rollers 43 to the image printing section 60 at a predetermined timing. The line sensor S2 reads the reference mark M after fixing on the front surface from under the reversed sheet P. Position information on the reference mark M read by the line sensor S2 is output to the arithmetic operating section 2 shown in FIG. 6.

For example, when the line sensor S2 scans two portions on the scanning lines L4 and L5 of the reference mark M, as shown in FIG. 7, it reads the points P1 to P3 where the scanning line L4 intersects the reference mark M and the points P4 to P6 where the scanning line L5 intersects the reference mark M.

(Step S05)

In step S05, the first length calculation unit 2A obtains the length Y2 between the points P1 and P3. Alternatively, the first length calculation unit 2A can obtain the length between the points P4 and P6 and determine it as the length Y2. The length Y2 represents the length of the reference mark M after fixing in the main scanning direction on the front surface. The first length calculation unit 2A also obtains the length A between the points P2 and P3, the length B between the points P1 and P2, the length C between the points P5 and P6, and the length D between the points P4 and P5. Information on the length Y2 of the reference mark M after fixing in the main scanning direction is output to the second length calculation unit 2B and shrinkage factor calculation unit 2C. Pieces of information on the lengths B and D are output to the second length calculation unit 2B.

(Step S06)

In step S06, the second length calculation unit 2B obtains the length X2 of the reference mark M in the sub-scanning direction on the basis of the convey speed of the sheet P, the main-scanning time interval required when the line sensor S2 scans in the main scanning direction along the scanning lines L5 and L4, and the lengths Y2, B, and D. The second length calculation unit 2B obtains the length X2 in the sub-scanning direction in accordance with the above equation (1). Information on the length X2 is output to the shrinkage factor calculation unit 2C.

(Step S07)

In step S07, the shrinkage factor calculation unit 2C obtains the shrinkage factor of the sheet P on the basis of the lengths X2 and Y2 obtained by the first and second length calculation units 2A and 2B and the lengths X1 and Y1 of the reference mark M in mark printing which are stored in the storage section 3. X2/X1 corresponds to the shrinkage factor in the sub-scanning direction, and Y2/Y1 corresponds to the shrinkage factor in the main scanning direction. For example, if X1=10 [mm], Y1=10 [mm], X2=9.9 [mm], and Y2=9.9 [mm], the shrinkage factor in the sub-scanning direction is 99 [%], and the shrinkage factor in the main scanning direction is also 99 [%].

(Step S08)

In step S08, the magnification determination unit 2D determines the magnification of the image to be printed on the back surface on the basis of the shrinkage factor obtained in step S07. The magnification determination unit 2D reduces the original image data on the image to be printed on the back surface in accordance with the shrinkage factor obtained by the shrinkage factor calculation unit 2C. For example, if the shrinkage factor in the sub-scanning direction is 99 [%], the length in the sub-scanning direction of the image data for the image to be printed on the back surface is set to 99 [%] the original image data. If the shrinkage factor in the main scanning direction is 99 [%], the length in the main scanning direction of the image data for the image to be printed on the back surface is set to 99 [%] the original image data. Thus, the image data for the image to be printed on the back surface is reduced as a whole to 97.01 [%] the original image data to print an image on the back surface on the basis of the image data.

(Step S09)

In step S09, the position determination unit 2E determines the position of the image to be printed on the back surface on the basis of the shrinkage factor obtained in step S07. The position determination unit 2E determines the position of the image printing region on the back surface with reference to the position of the reference point PA after fixing. The position of the reference point PA after fixing on the front surface shifts by an amount corresponding to the shrinkage factor of the sheet P. Thus, the image printing region on the back surface is determined with reference to the reference point PA after fixing which has shifted.

In mark printing, as shown in FIG. 4, the reference mark M is printed such that the reference point PA is located at a position which is at the distance a from the trailing edge of the sheet P and at the distance b from the side surface of the sheet P. However, the position of the reference point PA after fixing shifts by the amount corresponding to the shrinkage factor of the sheet P to be located at the distance c from the trailing edge and at the distance d from the side surface, as shown in FIG. 7. For example, if the shrinkage factor in the main scanning direction is 99 [%] and the shrinkage factor in the sub-scanning direction is 99 [%], the distance c is shorter than the distance a by 1.0 [%], and the distance d is shorter than the distance d by 1.0 [%]. In this manner, the position which shifts by the amount corresponding to the shrinkage factor is determined as the reference point PA after fixing. The position which is at the distance c from the trailing edge and at the distance d from the side surface is determined as the position of the reference point PA, and a position spaced apart from the reference point PA by a predetermined distance is determined as the boundary of the image printing region on the back surface.

(Step S10)

In step S10, the image printing section 60 prints an image on the back surface of the sheet P. At this time, an image reduced by an amount corresponding to the shrinkage factor is printed in the image printing region on the back surface determined in step S09. As a result, even if the sheet P shrinks due to the fixing process after the image is printed on the front surface, the image is printed on the back surface by determining its position and magnification in accordance with the shrinkage. Thus, the position and size of the image printed on the front surface can be set to coincide with the position and size of the image printed on the back surface.

As in the image printing apparatus according to the first embodiment, the shrinkage factor of the sheet P can be obtained by only printing the reference mark M at one portion on the sheet P. The line sensor S2 can thus be more downsized than the prior art, and the read range of the line sensor S2 can be narrowed more than the prior art. As the read range of the line sensor S2 can be narrowed, the capacity of the memory to save data read by the line sensor S2 can be decreased.

As the reference mark M is printed at one portion on the sheet P, it can be read by the line sensor S2 within a short period of time. Hence, the line sensor S2 can be set upstream of the image printing section 60, and can read the reference mark M to obtain the magnification and position of the image to be printed on the back surface. In this manner, as the position and magnification of the image are determined on the basis of the reference mark M which is read immediately before printing the image on the back surface, the accuracies of the position and magnification can improve.

A blowing mechanism may be provided as a removing member for the line sensor S2, to remove a foreign substance such as paper dust attaching to the line sensor S2 by blowing.

Second Embodiment

Figure 9:
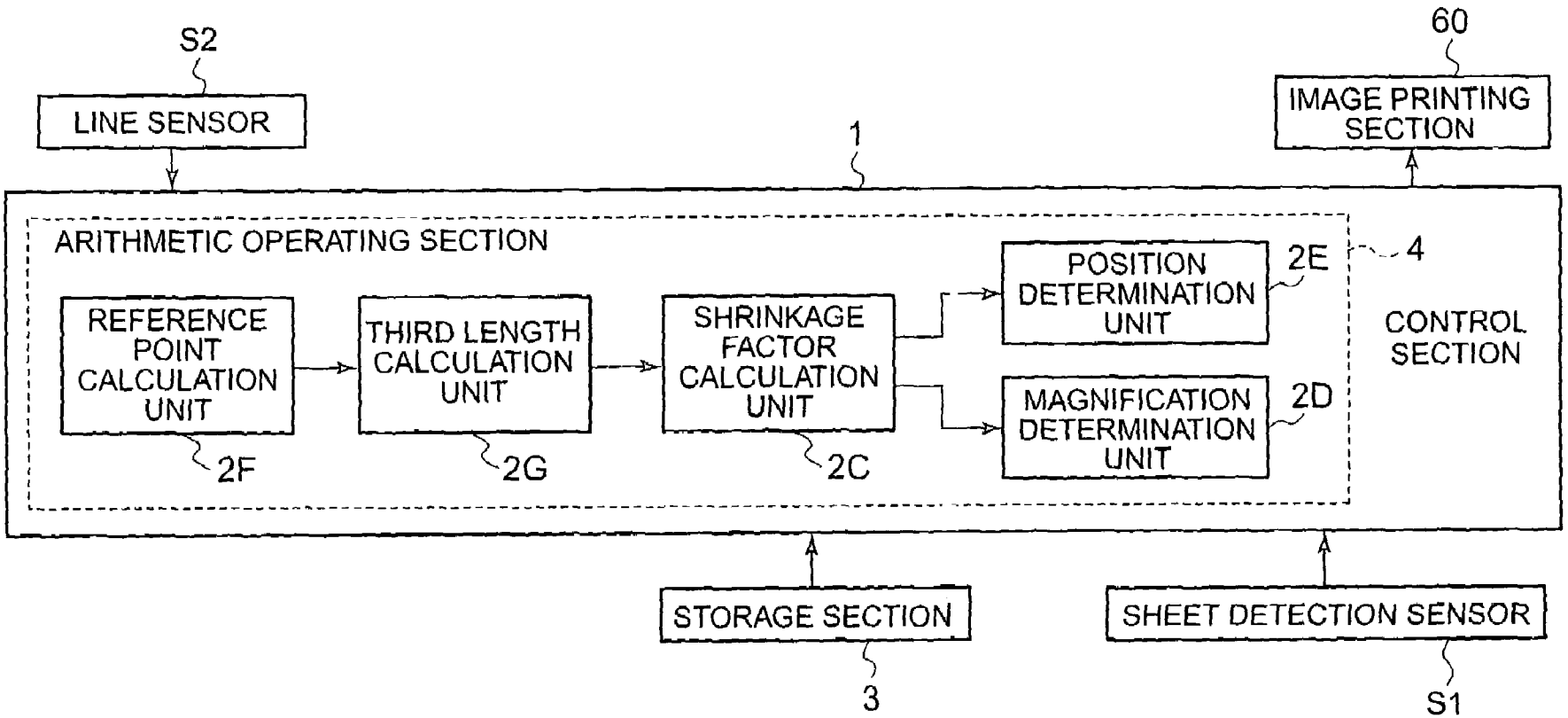
FIG. 9 is a control block diagram of an image printing apparatus according to the second embodiment.

The arrangement of an image printing apparatus according to the second embodiment is the same as that of the image printing apparatus according to the first embodiment, and a description thereof will accordingly be omitted. Differences between the first and second embodiments will be described with reference to the control block diagram of the image printing apparatus according to the second embodiment shown in FIG. 9.

The image printing apparatus according to the second embodiment comprises a reference point calculation unit 2F and third length calculation unit 2G in place of the first and second length calculation units 2A and 2B provided to the image printing apparatus according to the first embodiment. Except for this, the image printing apparatus according to the second embodiment is identical to that of the first embodiment.

Figure 10A:
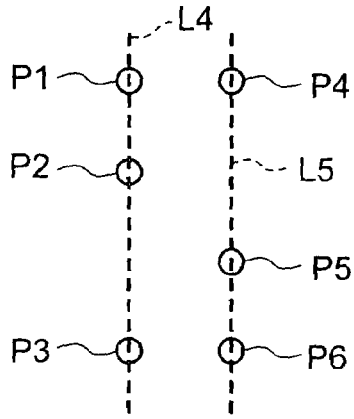
FIGS. 10A to 10C are views for explaining a process of obtaining the position and magnification of the image to be printed on the back surface.
Figure 10B:
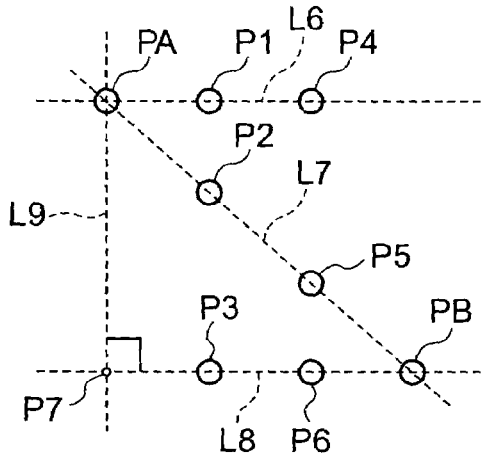
Figure 10C:
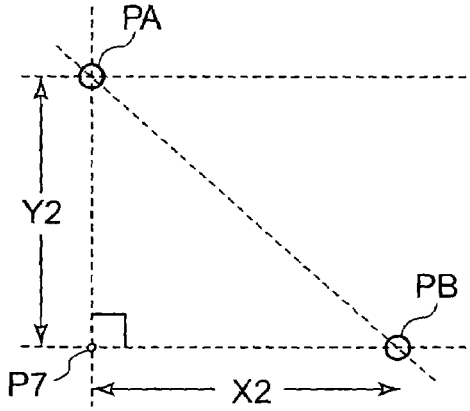

The processes performed by the reference point calculation unit 2F and third length calculation unit 2G will be described with reference to FIGS. 7, 9, and 10A to 10C. FIGS. 10A to 10C are views for explain a process of obtaining the position and magnification of an image to be printed on the back surface.

In the same manner as in the first embodiment, when a line sensor S2 scans two portions on scanning lines L4 and L5 of a reference mark M, as shown in FIGS. 7 and 10A, it reads points P1 to P3 where the scanning line L4 intersects the reference mark M and points P4 to P6 where the scanning line L5 intersects the reference mark M. Alternatively, the line sensor S2 may scan three or more portions of the reference mark M.

As shown in FIG. 10B, the reference point calculation unit 2F extends an imaginary line L6 which connects the points P1 and P4, an imaginary line L7 which connects the points P2 and P5, and an imaginary line L8 which connects the points P3 and P6. The reference point calculation unit 2F determines points where these straight lines intersect as reference points PA and PB after fixing on the front surface.

As shown in FIG. 10C, the third length calculation unit 2G extends the imaginary line L8 which connects the points P3 and P6, draws an imaginary line L9 as a perpendicular from the reference point PA to the imaginary line L8, and obtains a length Y2 from the reference point PA to an intersection point P7 of the imaginary lines L8 and L9. The third length calculation unit 2G also obtains a length X2 from the intersection point P7 to the reference point PB.

A shrinkage factor calculation unit 2C obtains the shrinkage factor of a sheet P from the lengths X2 and Y2 obtained by the third length calculation unit 2G and lengths X1 and Y1 of the reference mark M in mark printing which are stored in the storage section 3. X2/X1 corresponds to the shrinkage factor in the sub-scanning direction, and Y2/Y1 corresponds to the shrinkage factor in the main scanning direction.

For example, if X1=10 [mm], Y1=10 [mm], X2=9.9 [mm], and Y2=9.9 [mm], the shrinkage factor in the sub-scanning direction is 99 [%], and the shrinkage factor in the main scanning direction is also 99 [%].

A magnification determination unit 2D determines the magnification of image data, when an image is to be printed on the back surface, on the basis of the shrinkage factor of the sheet P calculated by the shrinkage factor calculation unit 2C. The magnification determination unit 2D reduces the original back surface image data in accordance with the shrinkage factor. For example, if the shrinkage factor in the sub-scanning direction is 99 [%] and the shrinkage factor in the main scanning direction is 99 [%], the lengths in the sub-scanning direction and main scanning direction are reduced to 99 [%] the lengths of the original image data.

In the same manner as in the first embodiment, a position determination unit 2E determines the position of the image printing region on the back surface on the basis of the shrinkage factor of the sheet P which is calculated by the shrinkage factor calculation unit 2C. The position determination unit 2E determines a position shifting from the position of the reference point PA in mark printing by an amount corresponding to the shrinkage factor as the reference point PA of the image on the front surface after fixing. As shown in FIG. 7, a point at a distance c from the trailing edge and a distance d from the side surface is determined as the position of the reference point PA, and a position spaced apart from the reference point PA by a predetermined distance is determined as the boundary of the image printing region on the back surface.

Figure 11:
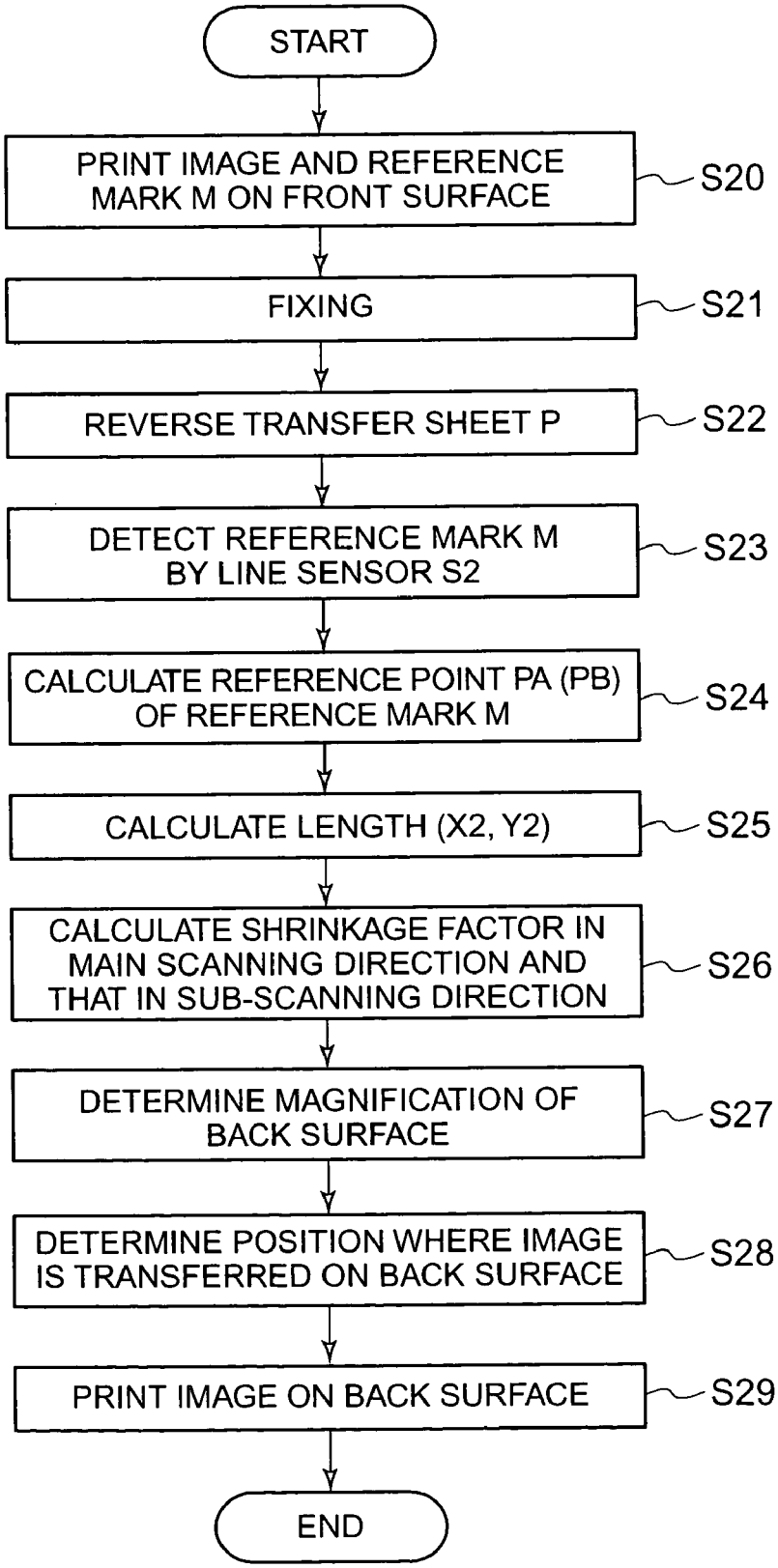
FIG. 11 is a flowchart showing the control operation of the image printing apparatus according to the second embodiment.

The control operation of the image printing apparatus according to the second embodiment of the present invention will be described with reference to FIG. 11. FIG. 11 is a flowchart showing the control operation of the image printing apparatus according to the second embodiment of the present invention.

(Step S20)

In step S20, in the same manner as in step S01 of the first embodiment, an image printing section 60 prints an image and the reference mark M on the front surface of the sheet P. The image printing section 60 prints an image at a position preset with reference to the leading edge of the sheet P, as shown in FIG. 3. Furthermore, the image printing section 60 prints cutting marks K1 to K4, and the substantially Z-shaped reference mark M shown in FIG. 4 at a preset position in a region outside the cutting marks K1 to K4.

A storage section 3 stores the size and position information on the reference mark M in mark printing in the same manner as in the first embodiment. For example, as the size of the reference mark M, the length X1 in the sub-scanning direction and the length Y1 in the main scanning direction during mark printing are stored in the storage section 3. As the position information on the reference mark M, the position information on the reference point PA is stored. For example, a distance a from the trailing edge of the sheet P and a distance b from the side surface are stored in the storage section 3 as the position information on the reference point PA.

(Step S21)

In step S21, the sheet P is conveyed to a fixing unit 70, in the same manner as in step S02 of the first embodiment. The fixing unit 70 fixes the images of the cutting marks K1 to K4 and reference mark M on the front surface.

(Step S22)

In step S22, the sheet P fixed with the image on its front surface is reversed and conveyed to the image printing section 60 again, in the same manner as in step S03 of the first embodiment.

(Step S23)

In step S23, as shown in FIG. 5, at a predetermined timing, registration rollers 43 feed the reversed sheet P to the image printing section 60, in the same manner as in step S04 of the first embodiment. The line sensor S2 reads the reference mark M after fixing on the front surface from under the reversed sheet P. Position information on the reference mark M read by the line sensor S2 is output to a control section 1 having an arithmetic operating section 4 shown in FIG. 9.

For example, when the line sensor S2 scans two portions on the scanning lines L4 and L5 of the reference mark M, as shown in FIGS. 7 and 10A, it reads the points P1 to P3 where the scanning line L4 intersects the reference mark M and the points P4 to P6 where the scanning line L5 intersects the reference mark M, to detect the reference mark M.

(Step S24)

In step S24, the reference point calculation unit 2F obtains the reference point of the reference mark M after fixing on the front surface. For example, as shown in FIG. 10B, the reference point calculation unit 2F extends the imaginary line L6 which connects the points P1 and P4, the imaginary line L7 which connects the points P2 and P5, and the imaginary line L8 which connects the points P3 and P6. The reference point calculation unit 2F determines points where these straight lines intersect as the reference points PA and PB after fixing on the front surface.

(Step S25)

In step S25, as shown in FIG. 10C, the third length calculation unit 2G extends the imaginary line L8 which connects the points P3 and P6, draws the imaginary line L9 as the perpendicular from the reference point PA to the imaginary line L8, and obtains the length Y2 from the reference point PA to the intersection point P7 and the length X2 from the intersection point P7 to the reference point PB.

(Step S26)

In step S26, the shrinkage factor calculation unit 2C obtains the shrinkage factor of the sheet P on the basis of the lengths X2 and Y2 obtained by the third length calculation unit 2G and the lengths X1 and Y1 of the reference mark M in mark printing which are stored in the storage section 3. X2/X1 corresponds to the shrinkage factor in the sub-scanning direction, and Y2/Y1 corresponds to the shrinkage factor in the main scanning direction. For example, if X1=10 [mm], Y1=10 [mm], X2=9.9 [mm], and Y2=9.9 [mm], the shrinkage factor in the sub-scanning direction is 99 [%], and the shrinkage factor in the main scanning direction is also 99 [%].

(Step S27)

In step S27, the magnification determination unit 2D determines the magnification of the image to be printed on the back surface on the basis of the shrinkage factor obtained in step S26. In the same manner as in step S08 of the first embodiment, the magnification determination unit 2D reduces the original back surface image data in accordance with the shrinkage factor obtained by the shrinkage factor calculation unit 2C. For example, if the shrinkage factor in the sub-scanning direction is 99 [%] and the shrinkage factor in the main scanning direction is 99 [%], the lengths in the sub-scanning direction and main scanning direction are reduced to 99 [%] the lengths of the original image data.

(Step S28)

In step S28, in the same manner as in step S09 of the first embodiment, the position determination unit 2E determines the position of the image to be printed on the back surface on the basis of the shrinkage factor obtained in step S26. The position determination unit 2E determines a position shifted from the position of the reference point PA in mark printing by an amount corresponding to the shrinkage factor as the reference point PA of the image on the front surface after fixing. As shown in FIG. 7, the position determination unit 2E determines a position at the distance c from the trailing edge and the distance d from the side surface as the reference point PA, and a position spaced apart from the reference point PA by a predetermined distance as the boundary of the image printing region on the back surface.

(Step S29)

In step S29, the image printing section 60 prints an image on the back surface of the sheet P, in the same manner as in step S10 of the first embodiment. At this time, an image reduced by an amount corresponding to the shrinkage factor is printed in the image printing region on the back surface determined in step S28. As a result, even if the sheet P shrinks due to the fixing process after the image is printed on the front surface, the image is printed on the back surface by determining its the position and magnification in accordance with the shrinkage. Thus, the position and size of the image printed on the front surface can be set to coincide with the position and size of the image printed on the back surface.

In the same manner as in the image printing apparatus according to the first embodiment, the line sensor S2 can be downsized more than the prior art, and the read range of the line sensor S2 can be narrowed more than the prior art. Also, the capacity of the memory to save data read by the line sensor S2 can be decreased. Since the reference mark M is printed at one portion on the sheet P in the same manner as in the image printing apparatus according to the first embodiment, it can be read by the line sensor S2 within a short period of time. Hence, the reference mark M can be read immediately before printing an image on the back surface, so the accuracies of the position and magnification can be improved.

Furthermore, in the same manner as in the image printing apparatus according to the first embodiment, a blowing mechanism may be provided as a removing member for the line sensor S2, to remove a foreign substance such as paper dust attaching to the line sensor S2 by blowing air or the like.

What is claimed is:

1. An image printing apparatus for printing images on front and back surfaces of a sheet, comprising:

an image printing section which forms the image for the front surface of the sheet as well as an image of a reference mark on a photosensitive member at one portion in a region outside an image region and transfers the images formed on the photosensitive member onto the front surface of the sheet;

a fixing unit which fixes the transferred images on the sheet;

a sensor which detects the reference mark by scanning at least two scanning lines of the reference mark after fixing printed on the front surface of the sheet;

an arithmetic operating section which obtains a shrinkage factor of the sheet on the basis of a size of one and only one reference mark before fixing and a size of the one and only one reference mark after fixing and calculates a position and magnification of the image to be printed on the back surface on the basis of the shrinkage factor; and a control section which performs control operation to print the image on the back surface of the sheet on the basis of the calculated position and the calculated magnification.

2. An apparatus according to claim 1, wherein the region outside the image region comprises a region outside the image region in a direction perpendicular to a convey direction of the sheet.

3. An apparatus according to claim 1, wherein the sensor is set in a direction perpendicular to a convey direction of the sheet.

4. An apparatus according to claim 3, wherein the sensor scans the reference mark a plurality of number of times in main scanning to read not less than two portions of the reference mark in a sub-scanning direction, thereby detecting the reference mark.

5. An apparatus according to claim 1, wherein the reference mark comprises a first straight line, a second straight line, and a third straight line, the first straight line and the second straight line being parallel to a convey direction of the sheet, and the third straight line intersecting the first straight line and the second straight line.

6. An apparatus according to claim 5, wherein the arithmetic operating section comprises:

a reference point calculation unit which obtains a first reference point where the first straight line and the third straight line intersect and a second reference point where the second straight line and the third straight line intersect on the basis of the read result;

a third length calculation unit which obtains a first length between the first reference point and the second straight line and a second length between the second reference point and a point where a line passing through the first reference point and perpendicular to the second straight line intersects the second straight line;

a shrinkage factor calculation unit which obtains a shrinkage factor of the sheet after fixing on the basis of the first length and the second length; and a determination unit which determines a position and magnification of an image to be printed on the back surface in accordance with the shrinkage factor.

7. An apparatus according to claim 6, wherein the shrinkage factor calculation unit obtains a shrinkage factor in a direction perpendicular to the convey direction of the sheet from a ratio of the first length of the reference mark before fixing to the first length of the reference mark after fixing which is calculated by the third length calculation unit, and a shrinkage factor in the convey direction of the sheet from a ratio of the second length of the reference mark before fixing to the second length of the reference mark after fixing which is calculated by the third length calculation unit.

8. An apparatus according to claim 1, wherein the reference mark comprises a first straight line, a second straight line, and a third straight line, the first straight line and the second straight line being parallel to the convey direction of the sheet, and the third straight line connecting an upstream end of the first straight line in the convey direction and a downstream end of the second straight line in the convey direction.

9. An apparatus according to claim 8, wherein the reference mark has a Z shape.

10. An apparatus according to claim 1, wherein the arithmetic operating section comprises:

a first length calculation unit which obtains a first length of the reference mark after fixing in a direction perpendicular to the convey direction on the basis of the read result;

a second length calculation unit which obtains a second length of the reference mark after fixing in a convey direction on the basis of a convey speed of the sheet in the convey direction, a time interval of main scanning done by the sensor, and the first length;

a shrinkage factor calculation unit which obtains the shrinkage factor of the sheet after fixing on the basis of the first length and the second length; and a determination unit which determines a position and magnification of the image to be printed on the back surface in accordance with the shrinkage factor.

11. An apparatus according to claim 10, wherein the shrinkage factor calculation unit obtains a shrinkage factor in a direction perpendicular to the convey direction of the sheet from a ratio of the first length of the reference mark before fixing to the first length of the reference mark after fixing which is calculated by the first length calculation unit, and a shrinkage factor in the convey direction of the sheet from a ratio of the second length of the reference mark before fixing to the second length of the reference mark after fixing which is calculated by the second length calculation unit.

12. An apparatus according to claim 1, wherein when the image is to be formed on the front surface of the sheet, the control section prints a cutting mark serving as a mark in cutting the sheet in a region outside the image region, and the reference mark at one portion in the region outside the image region further outside the cutting mark in a main scanning direction and a sub-scanning direction.

13. An apparatus according to claim 1, further comprising a registration roller, upstream of the image printing section in a convey direction of the sheet, which corrects a skew of the sheet, wherein the sensor is arranged between the image printing section and the registration roller.

14. An apparatus according to claim 1, further comprising a removing member which removes a foreign substance attaching to the sensor.

15. An image printing method of printing images on front and back surfaces of a sheet, comprising:

forming the image for the front surface of the sheet as well as an image of a reference mark on a photosensitive member at one portion in a region outside an image region and transferring the images formed on the photosensitive member onto the front surface of the sheet;

fixing the images on the sheet;

detecting the reference mark by scanning at least two scanning lines of the reference mark after fixing printed on the front surface of the sheet with a sensor;

obtaining a shrinkage factor of the sheet on the basis of a size of one and only one reference mark before fixing and a size of the one and only one reference mark after fixing and determining a position and magnification of the image to be printed on the back surface on the basis of the shrinkage factor; and printing the image on the back surface of the sheet on the basis of the position and magnification.

16. A method according to claim 15, wherein the region outside the image region comprises a region outside the image region in a direction perpendicular to a convey direction of the sheet.

17. A method according to claim 15, wherein the sensor is set in a direction perpendicular to a convey direction of the sheet.

18. A method according to claim 17, comprising scanning the reference mark a plurality of number of times in main scanning by the sensor to read not less than two portions of the reference mark in a sub-scanning direction, thereby detecting the reference mark.

19. A method according to claim 18, wherein the obtaining a shrinkage factor of the sheet on the basis of a size of the reference mark before fixing and a size of the detected reference mark after fixing and determining a position and magnification of the image to be printed on the back surface on the basis of the shrinkage factor comprises:

obtaining a first length of the reference mark after fixing in a direction perpendicular to a convey direction on the basis of the read result;

obtaining a second length of the reference mark after fixing in the convey direction on the basis of a convey speed of the sheet in the convey direction, a time interval of main scanning done by the sensor, and the first length;

obtaining the shrinkage factor of the sheet after fixing on the basis of the first length and the second length; and determining a position and magnification of the image to be printed on the back surface in accordance with the shrinkage factor.

20. A method according to claim 19, wherein the obtaining the shrinkage factor of the sheet comprises obtaining a shrinkage factor in a direction perpendicular to the convey direction of the sheet from a ratio of the first length of the reference mark before fixing to the first length of the reference mark after fixing which is calculated in the obtaining a first length of the reference mark, and a shrinkage factor in the convey direction of the sheet from a ratio of the second length of the reference mark before fixing to the second length of the reference mark after fixing which is calculated in the obtaining a second length of the reference mark.

21. A method according to claim 15, wherein the reference mark comprises a first straight line, a second straight line, and a third straight line, the first straight line and the second straight line being parallel to a convey direction of the sheet, and the third straight line intersecting the first straight line and the second straight line.

22. A method according to claim 21, wherein the obtaining a shrinkage factor of the sheet on the basis of a size of the reference mark before fixing and a size of the detected reference mark after fixing and determining a position and magnification of the image to be printed on the back surface on the basis of the shrinkage factor comprises:

obtaining a first reference point where the first straight line and the third straight line intersect and a second reference point where the second straight line and the third straight line intersect on the basis of the read result;

obtaining a first length between the first reference point and the second straight line and a second length between the second reference point and a point where a line passing through the first reference point and perpendicular to the second straight line intersects the second straight line;

obtaining a shrinkage factor of the sheet after fixing on the basis of the first length and the second length; and determining a position and magnification of the image to be printed on the back surface in accordance with the shrinkage factor.

23. A method according to claim 22, wherein the obtaining a shrinkage factor of the sheet comprises obtaining a shrinkage factor in a direction perpendicular to the convey direction of the sheet from a ratio of the first length of the reference mark before fixing to the first length of the reference mark after fixing which is calculated in the obtaining a first length, and a shrinkage factor in the convey direction of the sheet from a ratio of the second length of the reference mark before fixing to the second length of the reference mark after fixing which is calculated in the obtaining a second length.

24. A method according to claim 15, wherein the reference mark comprises a first straight line, a second straight line, and a third straight line, the first straight line and the second straight line being parallel to the convey direction of the sheet, and the third straight line connecting an upstream end of the first straight line in the convey direction and a downstream end of the second straight line in the convey direction.

25. A method according to claim 24, wherein the reference mark has a Z shape.

26. A method according to claim 15, wherein the forming the image for the front surface of the sheet as well as an image of a reference mark comprises: when the image is to be formed on the front surface of the sheet, printing a cutting mark sewing as a mark in cutting the sheet in a region outside the image region, and the reference mark at one portion in the region outside the image region further outside the cutting mark in a main scanning direction and a sub-scanning direction.

* * * * *